US009487979B2

(12) United States Patent
Rogers

(10) Patent No.: US 9,487,979 B2
(45) Date of Patent: Nov. 8, 2016

(54) FORCE CLOSER

(71) Applicant: Mikhail Aleczandar Rogers, Ashland, MA (US)

(72) Inventor: Mikhail Aleczandar Rogers, Ashland, MA (US)

( * ) Notice: Subject to any disclaimer, the term of this patent is extended or adjusted under 35 U.S.C. 154(b) by 12 days.

(21) Appl. No.: 14/180,354

(22) Filed: Feb. 14, 2014

(65) Prior Publication Data

US 2015/0233160 A1 Aug. 20, 2015

(51) Int. Cl.

| | |
|---|---|
| ***E05C 17/56*** | (2006.01) |
| ***E05C 19/16*** | (2006.01) |
| ***E05B 63/00*** | (2006.01) |
| ***E05B 15/02*** | (2006.01) |
| ***E05B 17/00*** | (2006.01) |

(52) U.S. Cl.

CPC ..... *E05C 19/16* (2013.01); *E05B 15/02* (2013.01); *E05B 17/0045* (2013.01); *E05B 63/0043* (2013.01); *Y10T 292/11* (2015.04)

(58) Field of Classification Search

CPC ..... E05C 19/16; E05B 15/02; E05B 63/0043
USPC ..... 292/1, 251.5, 340; 70/276; 49/394
See application file for complete search history.

(56) References Cited

U.S. PATENT DOCUMENTS

| | | | | |
|---|---|---|---|---|
| 1,198,227 | A * | 9/1916 | Hinchey | 292/251.5 |
| 2,203,580 | A * | 6/1940 | Ronning | 335/285 |
| 2,209,809 | A * | 7/1940 | Burton | 335/302 |
| 2,240,035 | A * | 4/1941 | Catherall | 292/251.5 |
| 2,497,697 | A * | 2/1950 | Smith | 292/74 |
| 2,521,885 | A * | 9/1950 | Vasquez | 292/251.5 |
| 2,629,142 | A * | 2/1953 | Rifkin | 49/442 |
| 2,693,382 | A * | 11/1954 | Teetor | 292/251.5 |
| 2,694,237 | A * | 11/1954 | Rifkin | 49/423 |
| 2,694,592 | A * | 11/1954 | Borchers et al. | 292/251.5 |
| 2,719,050 | A * | 9/1955 | Teetor | 292/251.5 |
| 2,770,849 | A * | 11/1956 | Gavey | 49/400 |
| 2,786,702 | A * | 3/1957 | Teetor | 292/251.5 |
| 2,786,703 | A * | 3/1957 | Teetor | 292/251.5 |
| 2,840,408 | A * | 6/1958 | Scott et al. | 292/251.5 |
| 2,853,331 | A * | 9/1958 | Teetor | 292/251.5 |
| 2,906,553 | A * | 9/1959 | Wilson | 292/251.5 |
| 3,288,511 | A * | 11/1966 | Tavano | 292/251.5 |
| 3,593,458 | A * | 7/1971 | Wahlfeld et al. | 49/240 |
| 3,600,025 | A * | 8/1971 | Brainard | 292/251.5 |
| 3,691,688 | A * | 9/1972 | Kaiserswerth | 49/394 |
| 5,722,203 | A * | 3/1998 | Staples et al. | 49/380 |
| 6,630,877 | B2 * | 10/2003 | Manthey | 335/205 |
| 6,698,807 | B1 * | 3/2004 | Wacker | 292/341.14 |
| 6,874,827 | B1 * | 4/2005 | Dodson | 292/175 |
| 8,245,448 | B2 * | 8/2012 | Crane et al. | 49/380 |
| 2006/0170225 | A1 * | 8/2006 | Macken | 292/251.5 |
| 2007/0007775 | A1 * | 1/2007 | Gallas et al. | 292/251.5 |
| 2009/0250949 | A1 * | 10/2009 | Sharpe | 292/251.5 |
| 2011/0080009 | A1 * | 4/2011 | Redgrave | 292/251.5 |

FOREIGN PATENT DOCUMENTS

| | | |
|---|---|---|
| DE | 814855 | * 10/1951 |
| FR | 1068908 | * 7/1954 |
| FR | 1084066 | * 1/1955 |
| FR | 1179194 | * 5/1959 |

* cited by examiner

*Primary Examiner* — Carlos Lugo

(57) ABSTRACT

A system of converting a traditional door latch assembly of a door into a magnetic door latch.

8 Claims, 2 Drawing Sheets

Fig 1 Front Elevation
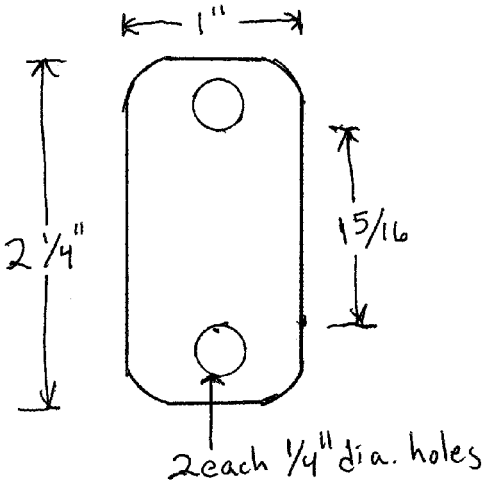
Fig 2 Side Elevation
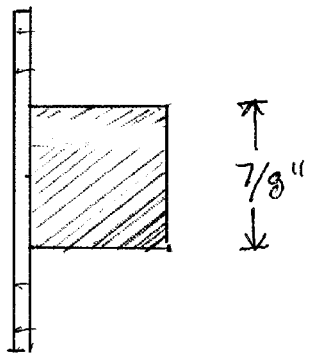
Fig 3 Cutaway
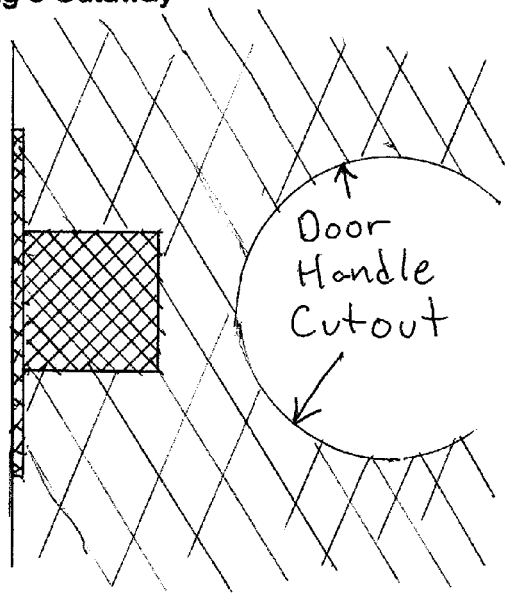
Fig 4 Plan
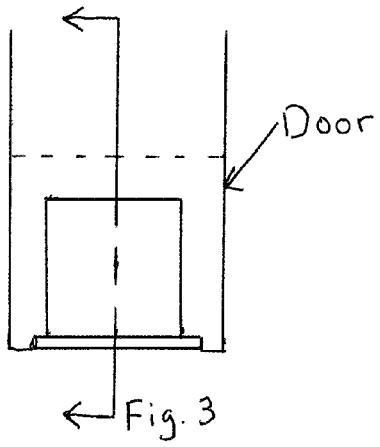

FORCE CLOSER

BACKGROUND OF THE INVENTION

This invention is intended to replace interior door latches.

SUMMARY OF THE INVENTION

The invention is related to converting a traditional door latch or backset of a door to a magnetic latch system. Thus, this invention in one aspect is intended to replace a traditional door latch assembly with a magnetic latch.

The Force Closer is a simplified replacement for some residential door latches or 'backsets.' Using magnetic attraction it does not have the ability to lock and is intended for use in nurseries, bedrooms and hall closets.

BRIEF DESCRIPTION OF THE DRAWINGS

FIG. 1 Front Elevation: A view of the only exposed portion of a Force Closer once installed in the edge of a door opposite the side that includes the hinges, showing dimensions that match the typical cutout of a majority of interior doors (not including antique mortised latches). These dimensions should include variations including a 1⅛" width and also squared corners.

FIG. 2 Side Elevation: The side view of a Force Closer consisting of a ⅛" thick metal plate (typically brass, but may be another material including brass plated steel, ferromagnetic materials including nickel and neodymium, or even plastic) with a ⅞" diameter magnet, or steel or plastic cylinder of a varying length glued to said plate.

FIG. 3 Cutaway: A view showing the Force Closer in its intended position and its relation to the cutout of a typical interior residential door. The Force Closer has taken the position of a latch and this view does not show the door handle (which would be located in the 2⅛" diameter hole marked by 'door handle cutout').

FIG. 4 Plan: A top down view of an interior residential door showing a theoretical cutaway view (FIG. 3) of the location of a Force Closer installed in the door latch positions (only the 'face' of the Force Closer would be exposed when installed—see FIG. 1).

DETAILED DESCRIPTION OF THE PREFERRED EMBODIMENTS

Figure 5:
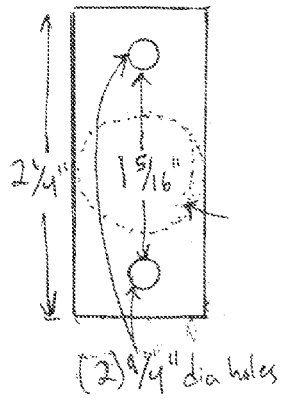
FIG. 5 Front Elevation: Another example of the view of the exposed portion of a Force Closer, this one without rounded corners.
Figure 6:
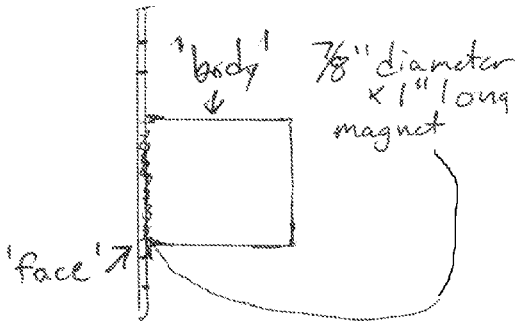
FIG. 6 Side Elevation: This view shows the two parts of a force closer. The 'face' refers to a plate typically made of brass, but may be constructed of another material including ferromagnetic materials. The 'body' refers to a cylindrical object made from steel, plastic, or a magnet constructed of any strength or type. The two parts are adhered together using an epoxy or adhesive.
Figure 7:
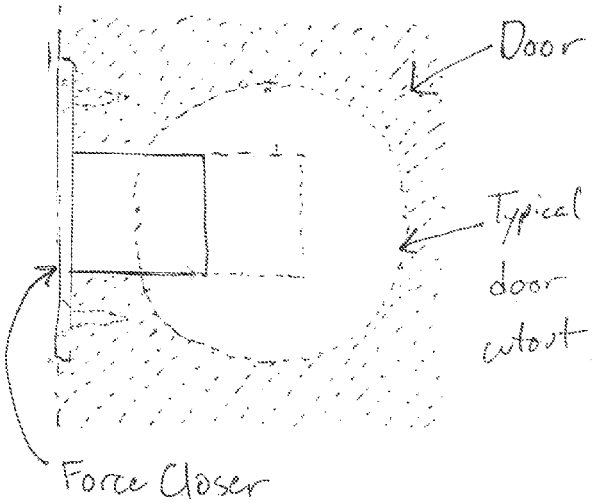
FIG. 7 Cutaway: Another cutaway view, this one showing the door, the cutout for a door handle, and a Force Closer taking the position of a typical door latch backset.
Figure 8:
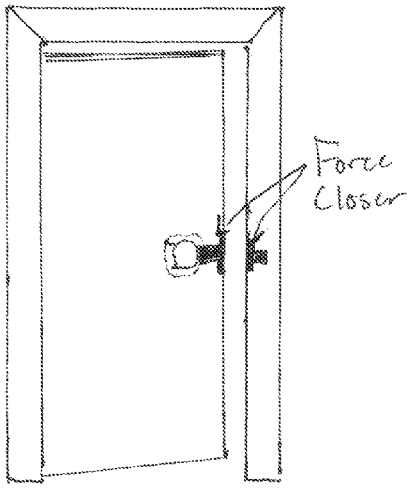
FIG. 8 Elevation: This view shows two Force Closers installed in both a door, and in its frame. This view also shows the relative location of the two Force Closers when the door is closed, allowing for their close proximity to use attractive magnetism to hold the door closed.

Two Force Closers installed together will hold the door closed. If the magnet of one Force Closer is replaced with a ⅞" diameter steel slug, it will still operate in a similar manner.

This latch replacement is created by adhering a magnet to a base plate or by creating a magnetic base plate (FIG. 2), both of which have dimensions (FIG. 1) sized to fit exactly the cutout made for a door latch, and found on most residential doors. It is intended as an improvement or replacement of mechanical latches and can be installed easily on new doors in conjunction with a door handle, or installed on doors with existing latches by removing the door handle, removing the door latch, installing the Force Closer (FIG. 3), then reinstalling the door handle. With the Force Closer installed, the door can be closed quietly simply by pushing it towards the closed position. Then the Force Closer will hold the door closed even if a gust of wind or a small animal pushed on it. This is beneficial in the case of a babies nursery because the door can be opened hands free (with the push of a hip) and closed quietly (so as not to disturb a sleeping baby) and still keep out small pets. A Force Closer would be beneficial on a child's bedroom door because it would prevent the door from being locked from the inside.

The Force Closer is the only magnetic closure designed as a latch replacement and sized to fit in the cutouts found in residential interior doors.

The 'face' or baseplate of the Force Closer can have varying widths, thicknesses, rounded or squared corners, and be made of varying materials whether metal, plastic, or ferromagnetic.

The 'body' of the Force Closer can be made of steel or a magnet with any degree of magnetism.

Placing a newborn in a crib and hoping for a full night of sleep can be difficult enough, but to have your child start crying because of the 'click' of a closing door latch can be frustrating.

Your five year old is having a 'play date' and their friend decides to press the button that locks the door to their room. Asking them to open the door and not getting a response can put you in a frenzy looking for something to unlock the door. Cover the door handle or replace the latch?

In both cases, something that could close the door quietly and without allowing it to lock would be ideal. The solution? The Force Closer. Replace the locking spring latch and strike plate with something designed to fit easily and exactly in its place. With a magnet in the door and a steel slug in the door frame, or a Force Closer in both locations for more closing power, there is a new way to close a door.

I claim:

1. A system for converting a traditional door latch assembly of a door into a magnetic door latch, the traditional door latch assembly comprising a door latch bolt mechanism and a handle assembly, the system comprising:

a faceplate, a cylindrical body, and a magnet secured between the faceplate and the cylindrical body, wherein, in order to convert the traditional door latch assembly into a magnetic door latch, the door assembly is uninstalled from the door by removing the handle assembly from the door cutout and removing the door latch bolt mechanism from a bolt bore on the door, the cylindrical body is installed into the bolt bore on the door and a faceplate is secured to the door and the handle assembly is reinstalled into the door cutout, wherein, in order to latch the door, the door is moved to a closed position having the magnet in a magnetic engagement with a striker plate, and, in order to open the door, the handle is pulled so as to move the magnet away from magnetic attraction with the striker plate.

2. The force closer of claim 1, wherein the faceplate is composed of a material selected from the group including metal, brass, brass plated steel, ferromagnetic materials including nickel and neodymium, and plastic.

3. The force closer of claim 1, wherein the faceplace is approximately 2¼ inches in height and 1 inch in width, and has opposing ¼ inch diameter holes near a top and a bottom of the faceplate such that the distance between the holes is 15/16 inches, and the magnet is approximately ⅞ inches in height.

4. The force closer of claim 1, wherein the faceplate itself is magnetic so that the faceplate is attachable to a steel or plastic cylindrical body.

5. The force closer of claim 1, wherein the faceplate itself is magnetic to enable it to use the cylindrical body as a guide in order for it to be attached to the door.

6. The force closer of claim 1, wherein the faceplate itself is magnetic such that it does not need to be secured to the cylindrical body.

7. A method for converting a traditional door latch assembly of a door into a magnetic door latch, the traditional door latch assembly comprising a door latch bolt mechanism and a handle assembly, the magnetic door latch comprising a Force Closer for being installed into a bolt bore on the door, the Force Closer comprising a faceplate and a magnet secured to the faceplate for magnetically engaging a ferrous striker plate or slug opposing the faceplate to hold the door in a closed position when engaged, the method comprising the steps of:

uninstalling the door latch assembly from the door by removing the handle assembly from the door cutout and removing the door latch bolt mechanism from the bolt bore on the door, in order to convert the traditional door latch assembly into a magnetic door latch:

installing the magnet into the bolt bore on the door and securing the faceplate to the magnet and thus to the door and re-installing the handle assembly into the door cutout, so that when the door is moved to a closed position having the magnet in a magnetic engagement with the ferrous striker plate or slug the door is latched, and when the door is moved to an open position the magnet moves away from magnetic attraction with the ferrous striker plate or slug to unlatch the door.

8. A method for converting a traditional door latch assembly of a door into a magnetic door latch, the traditional door latch assembly comprising a door latch bolt mechanism and a handle assembly, the magnetic door latch comprising a Force Closer for being installed into a bolt bore on the door, the Force Closer comprising a magnetic faceplate for magnetically engaging a ferrous striker plate or slug opposing the faceplate to hold the door in a closed position when engaged, the method comprising the steps of:

uninstalling the door latch assembly from the door by removing the handle assembly from the door cutout and removing the door latch bolt mechanism from the bolt bore on the door, in order to convert the traditional door latch assembly into a magnetic door latch;

installing a cylindrical body into the bolt bore on the door and securing the magnetic faceplate to the door and re-installing the handle assembly into the door cutout, so that when the door is moved to a closed position having the magnet in a magnetic engagement with the ferrous striker plate or slug the door is latched, and when the door is moved to an open position the magnet moves away from magnetic attraction with the ferrous striker plate or slug to unlatch the door.

* * * * *